US005456054A

United States Patent [19]

Coupet

[11] Patent Number: 5,456,054

[45] Date of Patent: Oct. 10, 1995

[54] SECTION BAR HAVING AN ELASTICALLY DEFORMABLE BRANCH FOR COVERING THE EDGE OF A PANEL OR OF A FIRST SECTION BAR, A FRAME ELEMENT AND A DOOR IMPLEMENTING SAID SECTION BARS

[76] Inventor: Jean-Marie Coupet, 3 rue du Quesne, 62840 Fleurbaix, France

[21] Appl. No.: 234,663

[22] Filed: Apr. 28, 1994

[30] Foreign Application Priority Data

Apr. 29, 1993 [FR] France ..... 93 05314

[51] Int. Cl.[6] ..... E04C 2/38

[52] U.S. Cl. ..... 52/773; 52/656.4; 52/730.6; 52/775; 49/458

[58] Field of Search ..... 52/730.6, 823, 52/656.4, 204.51, 770, 771, 773, 775, 781.3, 204.67, 204.69, 204.7; 49/406, 458

[56] References Cited

U.S. PATENT DOCUMENTS

| | | | |
|---|---|---|---|
| 1,465,452 | 8/1923 | Matheny et al. | 52/781.3 X |
| 1,756,302 | 4/1930 | Pendery | 52/775 |
| 2,743,980 | 5/1956 | Hobbs | 52/823 X |
| 2,798,261 | 7/1957 | Greig | 52/823 |
| 3,163,702 | 12/1964 | Warhol | 52/823 X |
| 3,208,564 | 9/1965 | Sitterly | 52/775 X |
| 4,040,219 | 8/1977 | Budich | 52/730.6 X |
| 4,107,897 | 8/1978 | Ullman, Jr. | 52/823 |
| 4,606,170 | 8/1986 | Mendenhall | 52/823 X |
| 4,872,498 | 10/1989 | De Block et al. | 49/406 X |
| 5,139,846 | 8/1992 | Herwegh et al. | 52/770 X |
| 5,326,187 | 7/1994 | St. Marie et al. | 52/823 X |

FOREIGN PATENT DOCUMENTS

| | | | |
|---|---|---|---|
| 95-820 | 12/1983 | European Pat. Off. . | |
| 3306482 | 9/1983 | Germany | 52/204.69 |

*Primary Examiner*—Carl D. Friedman
*Assistant Examiner*—Laura A. Saladino
*Attorney, Agent, or Firm*—Ladas & Parry

[57] ABSTRACT

The covering section bar has a generally U-shaped inner housing defined by two side branches and a cross-bar, the first side branch having a fastening or snap-fastening shoulder and being elastically deformable at a first level of deformation, being of a thickness that is less than the mean thickness of the section bar, at least in the zone thereof where elastic deformation is required; the inner housing includes a first bearing zone corresponding to the fastening shoulder or situated close to the snap-fastening shoulder, a second bearing zone situated on the same side of the inner housing, and a third bearing zone situated on the second side branch and located in between the two first-mentioned bearing zones. The section bar covers either a panel or a panel-fastening section bar, after one or other of them has been inserted in its inner housing. The combination of the covering section bar and of the fastening section bar constitutes a panel frame element.

29 Claims, 6 Drawing Sheets

SECTION BAR HAVING AN ELASTICALLY DEFORMABLE BRANCH FOR COVERING THE EDGE OF A PANEL OR OF A FIRST SECTION BAR, A FRAME ELEMENT AND A DOOR IMPLEMENTING SAID SECTION BARS

FIELD OF THE INVENTION

The present invention relates to putting a frame on a panel, in particular for making a sliding or a pivoting cupboard door. It relates more particularly to a metal section bar for framing purposes, e.g. an aluminum extrusion, that confers both decorative appearance and also certain technical functions relating to door closure to panels that make up a door.

BACKGROUND OF THE INVENTION

It is common practice to make a door on the basis of a framework made of a first material and of decorative panels made of a second material. In modern furniture, the framework is often made of metal section bars that surround panels made of wood or the like.

Such metal section bars, in particular those made of anodized aluminium, contribute to the decorative appearance of the door and can also perform various technical functions such as protecting the edge of the panel or serving as handles when the door is a sliding door. The section bar in question is fixed to the panels by means of screws. The screws are preferably positioned in a hidden portion of the frame around the door.

However, when a sliding door is intended to separate two rooms, the screws for fixing the section bar onto the panel are necessarily visible from one of the two rooms.

OBJECTS AND SUMMARY OF THE INVENTION

The object of the Applicant is to propose a covering section bar that can be fixed effectively without additional fastening means, either directly to the edge of the panel or else to a fastening first section bar, such that under no circumstances can any fastening means be seen, and in particular any screws for fastening the first section bar to the panel remain hidden.

According to the invention, this object is fully achieved by means of a covering section bar for covering the edge of a panel or of a first section bar, the covering section bar including a generally U-shaped inner housing defined by two side branches and by a cross-bar, the first side branch having a fastening or snap-fastening shoulder and is elastically deformable at a first level of deformation, and being of smaller thickness than the mean thickness of the section bar, at least in the zone where elastic deformation is required, and the inner housing including a first bearing zone corresponding to the fastening shoulder or situated close to the snap-fastening shoulder, a second bearing zone situated on the same side of the inner housing, and a third bearing zone situated on the second side branch and located at an intermediate distance between the two first-mentioned bearing zones.

Preferably, the covering section bar of the invention is generally U-shaped, its elastically deformable first side branch is of a first given thickness and includes a front portion that acts as the second bearing zone close to the cross-bar, and its rear portion includes a fastening or snap-fastening shoulder that is of a second thickness less than the given first thickness.

Advantageously, the second branch is also elastically deformable and is of a third thickness less than the first.

Thus, while the first section bar is being inserted into the inner housing of the second section bar, it is possible successively to displace the first branch and then the second branch by applying different forces.

Advantageously, under such circumstances, the elastically deformable second side branch includes a shoulder facing the inside of the housing, with the end of the shoulder acting as a bearing zone for bearing against the first section bar. Because of this special disposition, it is possible to implement a panel whose edge is of a thickness that is slightly greater than normal thickness, as will appear more clearly on reading the following description.

The first elastically deformable branch preferably includes an outwardly-directed projection.

Advantageously, this projection is U-shaped, with the L-shaped bearing and snap-fastening end being situated at the end of the outermost flange of said U-shape. This U-shape projection not only imparts relief to the frame since it stands proud of the panel and also of the front portion of said branch, but it may also act as a handle for opening the door if the door is a sliding door.

Advantageously, the outwardly-directed projection of the first side branch has a curved cross-section and it includes an intermediate branch located in the inside zone of the projection and supporting the second bearing zone.

In an advantageous variant, the intermediate branch is itself elastically deformable. It extends obliquely from the first side branch in the portion thereof that is close to the cross-bar. The thickness of the first side branch is greater between the projection and the cross-bar than it is between the projection and its own free end where the first bearing zone is to be found.

Thus, in a particular disposition, two levels of elastic deformation can take place on the same side of the covering section bar, which levels can be brought into action in succession as a function of the deformation forces that are applied while inserting either a panel or else a fixing first section bar into said covering section bar, and as explained below. This disposition is particularly advantageous when the second side branch is itself also elastically deformable, with the thicknesses and lengths of the corresponding branches being chosen so as to obtain three successive levels of deformation: the first level on the first side branch, the second on the second side branch, and the third on the intermediate branch.

Another object of the invention is to provide a frame element made up of two section bars: a first section bar for fixing to a panel; and a second section bar for covering purposes and in accordance with the invention; said two section bars being suitable for cooperating and each including a respective inner housing: the first section bar having a housing for covering the edge of the panel; and the second section bar having a housing for receiving the first section bar. In addition, each section bar includes a branch that is elastically deformable, the first section bar for pressing against the edge of the panel after the panel has been forced into the inner housing of the first section bar, and the second section bar for bearing against the first section bar after it has been forced into the inner housing of said second section bar, thereby engaging the panel. Finally, the resiliently deformable branch of the second section bar includes a shoulder for snap-fastening to the first section bar when the first section bar is positioned in the inner housing of said second section bar.

Thus, an operator assembling the door forces the edge of the panel into the inner housing of the first section bar by displacing the elastically deformable branch thereof. Because of this deformable branch, the edge of the panel is held in position in the housing of the first section bar. Thereafter, the operator forces the first section bar clamped onto the edge of the panel into the housing of the second section bar by displacing the elastically deformable branch of said second section bar and until the first section bar snaps behind the shoulder of the second section bar. This ensures secure locking in position both of the panel inside the first section bar and of the first section bar inside the second.

If need be, the first section bar can be fixed to the edge of the panel by means of a screw passing through the first section bar and penetrating into the edge of the panel. Since the second section bar covers the first, the heads of the screws become totally hidden. In addition, if the operator desires to change the decoration of the door, it suffices to withdraw the covering section bar by undoing its snap-fastening and to replace it with another covering section bar of different appearance.

Another advantage in the present invention is that the same cladding element can be used for putting a frame on panels of different thicknesses. Under such circumstances, it suffices to use a first section bar for fastening purposes that is adapted to the thickness of the panel, while retaining the properties that enable it to be inserted in and snap-fastened in the covering section bar.

In a preferred variant embodiment, the first section bar has a cross-section that is substantially H-shaped, thereby defining two housings each of substantially U-shaped cross-section, thus enabling the first section bar to be used with panels of two thicknesses that are different or optionally the same.

A first section bar is thus provided that can be installed reversibly, and all the operator needs to do is turn it round to select the thickness appropriate for the panel that is to be framed.

In an advantageous variant whereby the covering section bar has an outer projection, the projection is itself in the form of a U-shaped section bar having an outer face that is substantially parallel to the panel when the panel is positioned in the housing of the first section bar which is in turn snapped into the inner housing of the second section bar. In addition, a sealing body can be fixed on the outside face of said projection. Finally, the branch facing the elastically deformable branch of the second section bar may include an outer projection of a disposition such that when the door comprises two sliding panels each of which has its edges provided with the frame element of the invention, said shoulder and the element corresponding to the front door and situated towards the back thereof penetrates into the sealing body of the rear door element when the door is in its closed position.

The sealing body is constituted, for example, by a strip on which long bristles are installed, or else by a flexible rubber tape.

In another embodiment, when the door is a pivoting door, the pivot shaft of the door is mounted inside the U-shaped projection of the elastically deformable branch of the second section member.

In a possible embodiment, relating to a door built up from a plurality of decorative panels, the first section bar of the invention may also be used as a junction member between various panels.

BRIEF DESCRIPTION OF THE DRAWINGS

The present invention will be better understood on reading the following description of various embodiments of the panel frame element made up of two co-operating section bars, and shown in the accompanying drawings, in which.

MORE DETAILED DESCRIPTION

The frame element 1 of the invention is made up of two section bars 2 and 3, advantageously made of metal, and in particular of aluminum which may be anodized or optionally painted.

Figure 1:
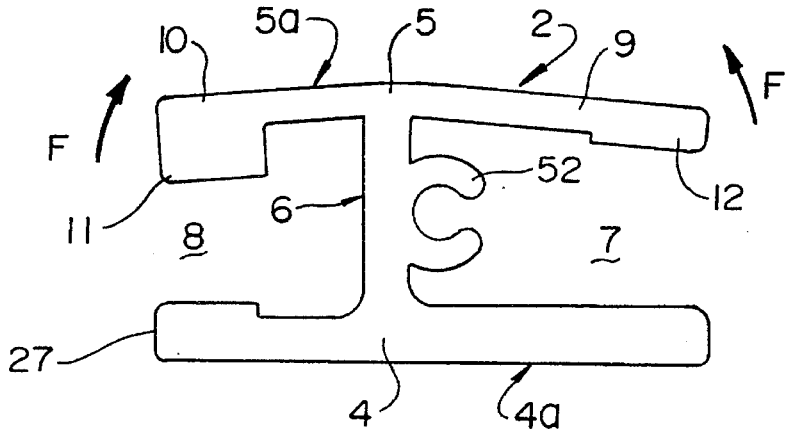
FIG. 1 is a cross-section view through a reversible first section bar.

The first section bar 2 as shown in particular in FIG. 1 is generally H-shaped in cross-section, having two side branches 4 and 5 and a cross-bar 6 that co-operate to define two partially-open inner housings 7 and 8. The edge of the panel that is to be framed by the element 1 is received in one of the housings 7 and 8.

The outside face 4*a* of the first side branch 4 is rectilinear. In addition, it is sufficiently thick to be relatively stiff on either side of the cross-bar 6.

The outside face 5*a* of the second side branch 5 is not rectilinear but is roof-shaped having two slopes that meet at a ridge overlying the cross-bar 6. This second side branch 5 is also of smaller thickness, at least in its zones close to the cross-bar 6, such that by exerting traction in the direction of arrows F, it is possible to deform each portion 9, 10 of said branch 5 elastically relative to the angular position it initially possesses at rest (FIG. 1) with respect to the cross-bar 6.

In addition, the free ends of the portions 9 and 10 of the second side branch 5 are of thicknesses that are increased to a greater or lesser extent, with the extra thickness extending into the corresponding housing 7 or 8. In the embodiment shown in FIGS. 1 and 4, the extra thickness 11 situated at the free end of the portion 10 is much greater than the extra thickness 12 situated at the free end of the portion 9.

This first section bar 2 is used for fixing the frame element 1 of the invention on the edge 13 of a panel 14. Naturally, the particular first section bar 2 is selected as a function of the thickness e of the edge 13 of the panel 14. More precisely, this thickness e corresponds substantially to the distance between the inside faces of the side branches 4 and 5 of the first section bar 2 between the free ends of said branches and after a certain amount of elastic deformation of the second side branch 5.

Figure 4:
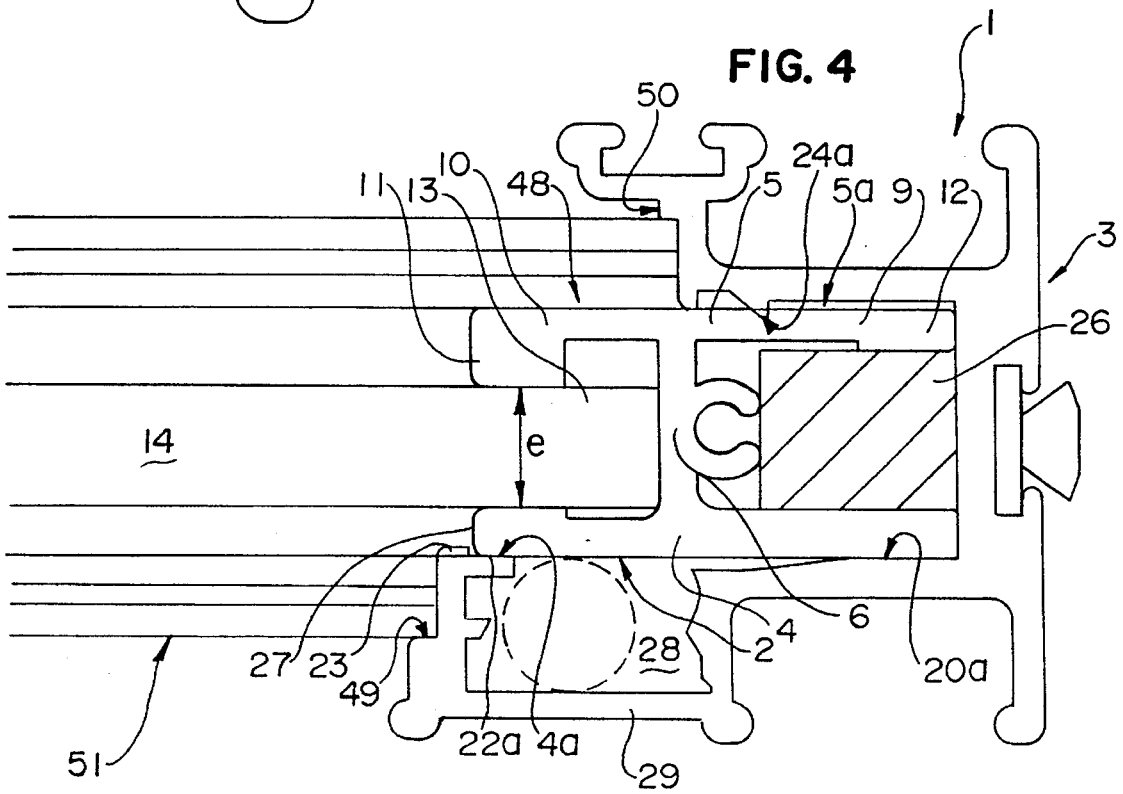
FIG. 4 is a fragmentary cross-section view showing how the first and second section bars of FIGS. 1 and 2 are mounted on the edge of a panel.

In order to fix the edge 13 of the panel 14 in the first section bar 2, the operator exerts traction in the direction of arrow F on the portion 10 of the elastically deformable second side branch 5 so as to enable the edge 13 of the panel 14 to be inserted inside the housing 8 until it bears against the cross-bar 6. After insertion, the portion 10 tends to return to its initial position and to press against the edge 13 of the panel 14. The first section bar 2 is thus held in place along the edge 13 by clamping thereon. The first section bar 2 is designed for framing two types of panel of determined thickness. If the edge of the panel is accurately of the thickness e, then the portion 10 becomes parallel to the side branch 4 (FIG. 4). However, if the thickness is slightly greater than that, then the housing can still receive it because of the increased thickness 11, but the portion 10 then diverges from the branch 4. If the thickness of the panel is smaller than e, then the portion 10 converges towards the branch 4.

The function of the covering second section bar 3 is to cover the first section bar 2 completely or partially once the second section bar has been put into position along the edge 13 of the panel 14.

To do this, it likewise includes an inner housing 15 together with an elastically deformable branch 16 like the branch 5 of the first section bar 2.

Figure 2:
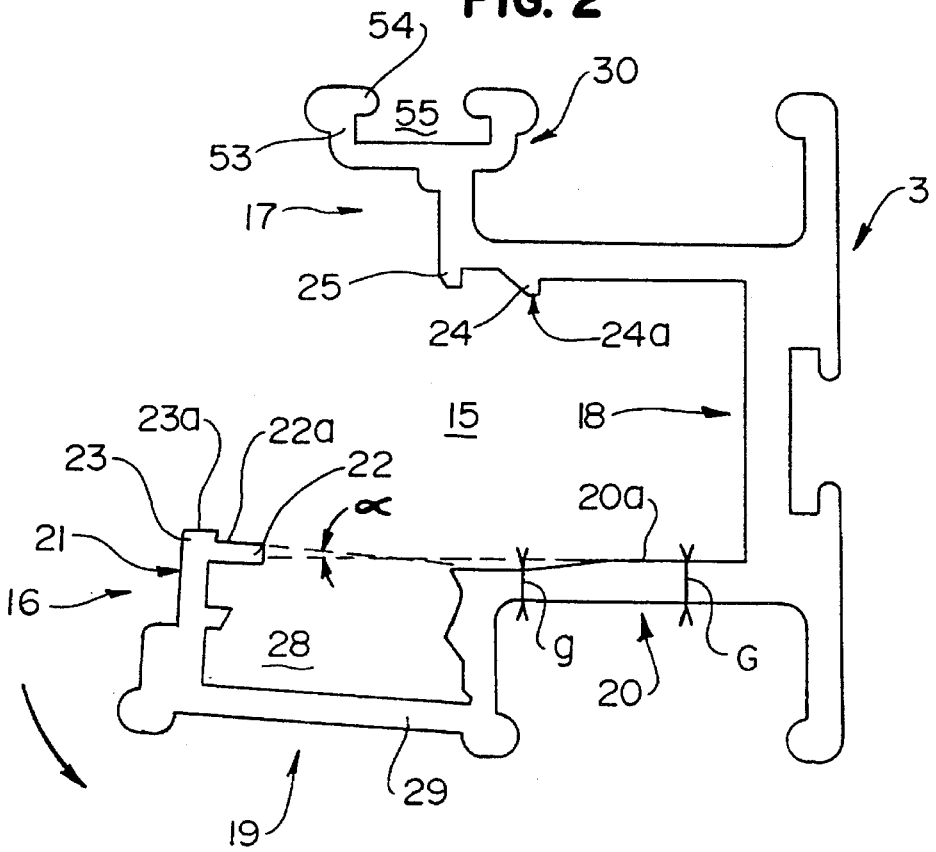
FIG. 2 is a section view through a covering second section bar having an outer projection in the form of a handle.

In the example shown in FIG. 2, the second section bar 3 has a generally U-shaped cross-section with a first side branch corresponding to the elastically deformable side branch 16 and a second side branch 17 that faces it and that is connected thereto by a cross-bar 18. The elastically deformable first side branch 16 has an outside projection 19 that is also generally U-shaped in cross-section, and which is connected to the cross-bar 18 via a first rectilinear length 20.

This first rectilinear length 20 is of thickness G close to the cross-bar 18 that is greater than its thickness g close to the outer projection 19.

The end 21 of the first side branch 16 of the second section bar 3 is terminated in an L-shape, having a bearing tab 22 and a snap-fastening tab 23. The bearing tab 22 has a face **22*a* facing towards the inside of the housing 15 that is substantially in line with the inside face of the length 20. More precisely, and as can be seen in FIG. 2, this inside face 22*a* of the bearing tab 22 forms an angle $\alpha$ with the direction taken by the inside face 20*a* of the length 20 in the proximity of the cross-bar 18**.

The second side branch 17 includes two inner shoulders 24 and 25. The first shoulder 24 has an intermediate position relative to the cross-bar 18 between the portion of the length 20 that is of thickness G and the bearing tab 22.

FIG. 4 shows the position taken up by the first section bar 2 engaged on the edge 13 of the panel 14 once it has itself been inserted inside the inner housing 15 of the second section bar 3.

After the edge 13 of the panel 14 has been inserted into the housing 8 of the first section bar 2, as described above, a block 26 is placed inside the other housing 7 of the first section bar 2. The thickness of the block is such as to enable the face **5*a* of the second elastically deformable branch 5 of said second section bar 2 to be kept rectilinear. Thus, the two portions 9 and 10 of the branch 5 are in line with each other and are no longer in the form of a two-slope roof as shown in FIG. 1**.

The first section bar 2 together with the block 26 is inserted into the housing 15 of the second section bar 3. To do this, the operator exerts traction in the direction of arrow H on the elastically deformable branch 16 of said second section bar 3 so as to displace said branch 16 far enough away to enable the first section bar 2 to be inserted into the portion of the inner housing 15 of the second section bar 3 that is close to the cross-bar 18. This forced insertion is continued until the first section bar 2 bears against the three bearing zones of the inner housing 15 constituted respectively by the face **20*a* of the length 20 where it is of thickness G, the inside face 22*a* of the bearing tab 22, and the face 24*a* of the first shoulder 24 on the second side branch 17, said face 24*a* being directed towards the other two bearing zones 20*a* and 22*a*. While this insertion is taking place, the inside face 23*a* of the shoulder 23 slides over the face 4*a* of the first side branch 4 of the first section bar 2. This sliding continues until the end 27 of said branch 4 passes beyond the snap-fastening tab 23 so that the face 4*a* of the side branch 4 bears against the inside face 22*a* of the bearing tab 22. The first section bar 2 is thus put into snap-fastening engagement inside the second section bar 3**.

The first section bar 2 is locked in position firstly because of the three bearing zones and secondly because of the snap-fastening tab 23. This locking in position is particularly effective, in all directions.

The U-shaped projection 19 on the elastically deformable branch 16 of the second section bar 3 gives a pleasing appearance to the frame element 1 since it gives said element a certain amount of relief relative to the panel 14 that it frames. In addition to this pleasing appearance, the projection 19 can participate in various technical improvements. For example, the inner housing 28 that it defines in co-operation with the first section bar (see FIG. 4) can be used to house a pivot shaft 110 when the door is a pivoting door. In addition, when the doors are sliding doors, the cross-bar 29 corresponding to the base of the U-shape constituted by said outer projection 19 can be used as a fastening zone for a sealing element or may co-operate with a sealing element placed on the other door.

Figure 5:
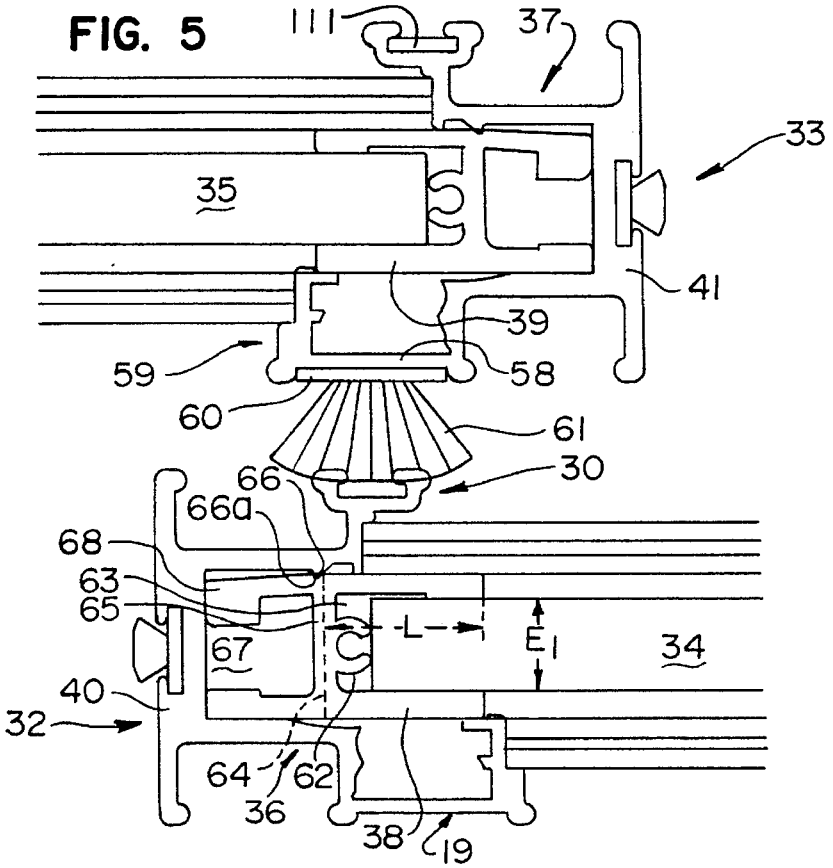
FIGS. 5 and 6 are fragmentary cross-section views of two frame elements in accordance with FIG. 4 and mounted on two sliding doors, together with a sealing element.
Figure 6:
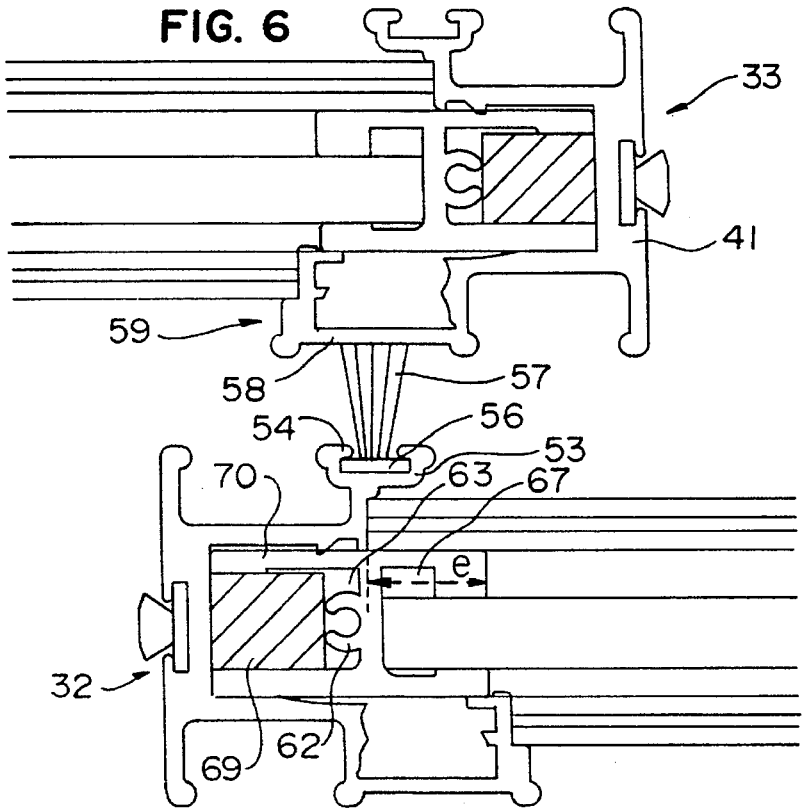

The second side branch 17 of the second section bar 3 has an outer shoulder 30 designed either to support a sealing element or else to co-operate with a sealing element placed on the other door, when the doors are sliding doors, as can be seen on examining FIG. 5, or else it can be used to support a decorative element. In the example described in FIG. 2, the shoulder 30 is U-shaped and its flanges 53 are terminated by thickenings 54 projecting towards the inside of the U-shape to define a housing 55 for slidably receiving a decorative strip 111 (FIG. 5) or a strip 56 that carries bristles 57 (FIG. 6).

FIG. 5 shows fragments of two sliding doors, a front door 32 and a rear door 33. Each door 32, 33 comprises a panel 34, 35 which is provided with a frame element of the invention 36, 37. These two elements 36, 37 are constituted respectively by first section bars 38, 39 and by second section bars 40, 41.

As can be seen in FIG. 5, the second section bar 40 of the front door 32 is disposed with its outer projection 19 facing the user, while its shoulder 30 is directed towards the inside of the cupboard.

In comparison, the same disposition is applied to the rear door 33. In addition, a strip 60 carrying bristles 61 has been fitted to the cross-bar 58 of the outer projection 59 of the second section bar 41 on the rear door 33 for the purpose of providing sealing between the two doors 32 and 33.

The spacing between the front door 32 and the rear door 33 is such that in the closed position, the outer shoulder 30 of the second section bar 40 on the front door 32 penetrates into the bristles 61 of the sealing strip 60 on the rear door 33. Dust is thus prevented from passing through the gap situated between the front and rear doors 32 and 33 when these two doors are in the closed position.

The sliding door example shown in FIG. 6 differs in that a sealing strip 56 is slidably mounted in the housing 55 of the shoulder 30 that is situated towards the rear face of the front door 32. When the two doors 32 and 33 are in the closed position, the bristles 57 of the strip 56 bear against the cross-bar 58 of the projection 59 on the second section bar of the rear door 33.

Another type of difference is illustrated in FIGS. 5 and 6: namely the effect of the thickness of the panels to be framed. In FIG. 5, the panel 34 has an edge of thickness $E_1$; it is inserted in the housing 63 of the first section bar 38 having the larger gap between its side branches. This housing also contains a screw channel 62. The length L of the housing 63 as measured from the midline 64 of the cross-bar 65 is substantially equal to the distance between the snap-fastening shoulder and the inner face 66*a* of the shoulder 66 that acts as the second bearing zone of the second section bar 40. As a result there is no need to insert a block in the second housing 67 of the first section bar 38 since the portion 68 is not involved in the engagement of the first section bar 38 inside the second section bar 40.

As can be seen in FIG. 6, it is also perfectly possible to frame a panel of smaller thickness, in which case it is the other housing 67 of the first section bar 38 that is used. This other housing 67 is of length l that is shorter than the length L of the first housing 63 given that it also contains the screw channel 62. Also, in this case, it is necessary to insert a block 69 in the first housing 63 so that firstly the bearing face 66*a* of the shoulder 66 can bear against the portion 70 of the first section bar 38 in an appropriate position, i.e. parallel to the other side branch of said first section bar 38, and secondly the first section bar 38 can come into abutment with the bottom of the inner housing of the second section bar 40.

As will be understood, the outer projection 19 may be used as a handle for opening or closing the sliding door.

Figure 3:
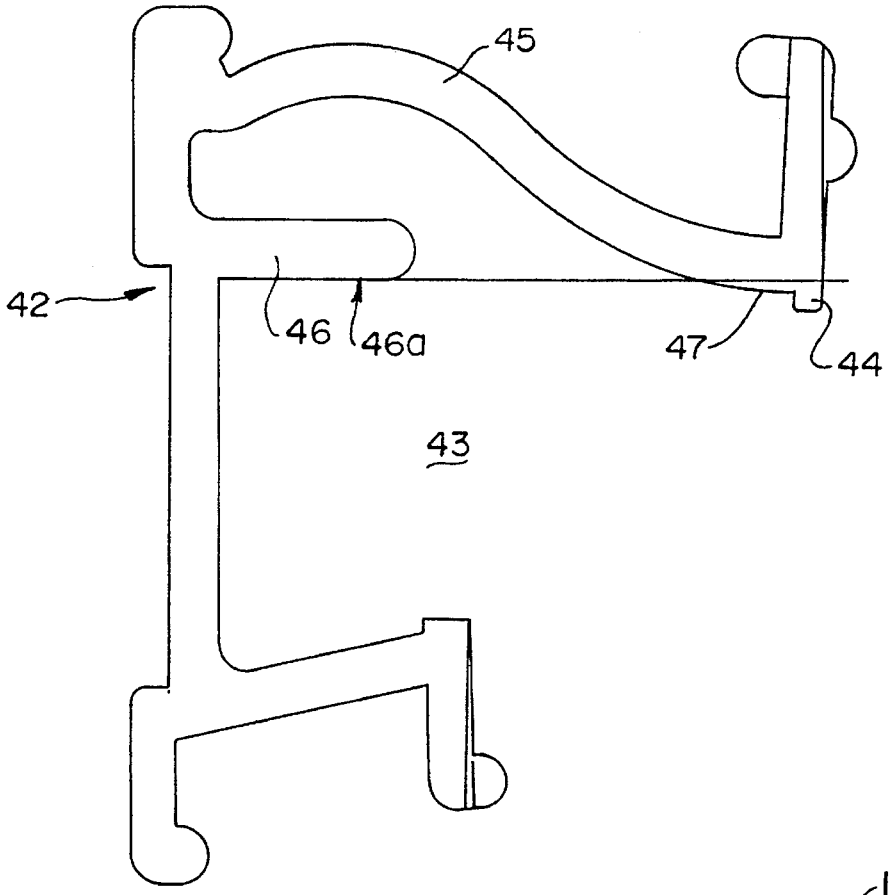
FIG. 3 is a cross-section view of another type of decorative second section bar.

FIG. 3 shows another embodiment of a second section bar 42 whose decorative appearance is quite different from the first embodiment shown in FIG. 2.

In this case, there can nevertheless be found the characteristic elements of the second section bar of the invention, namely: an inner housing 43 and a snap-fastening shoulder 44 mounted at the free end of an elastically deformable branch 45 having a thickness that is less than the average thickness of the section bar.

Unlike the first embodiment, the second bearing zone 46*a* is not on the elastically deformable branch 45 but is on an independent length 46 defining the inner housing 43, said length 46 projecting perpendicularly from the cross-bar.

An elastically deformable side branch 45 has an outwardly directed projection that is of curved shape, like a molding, and it terminates firstly in a first bearing zone 47 and secondly in a shoulder 44 that perform functions identical to those described above.

Figure 11:
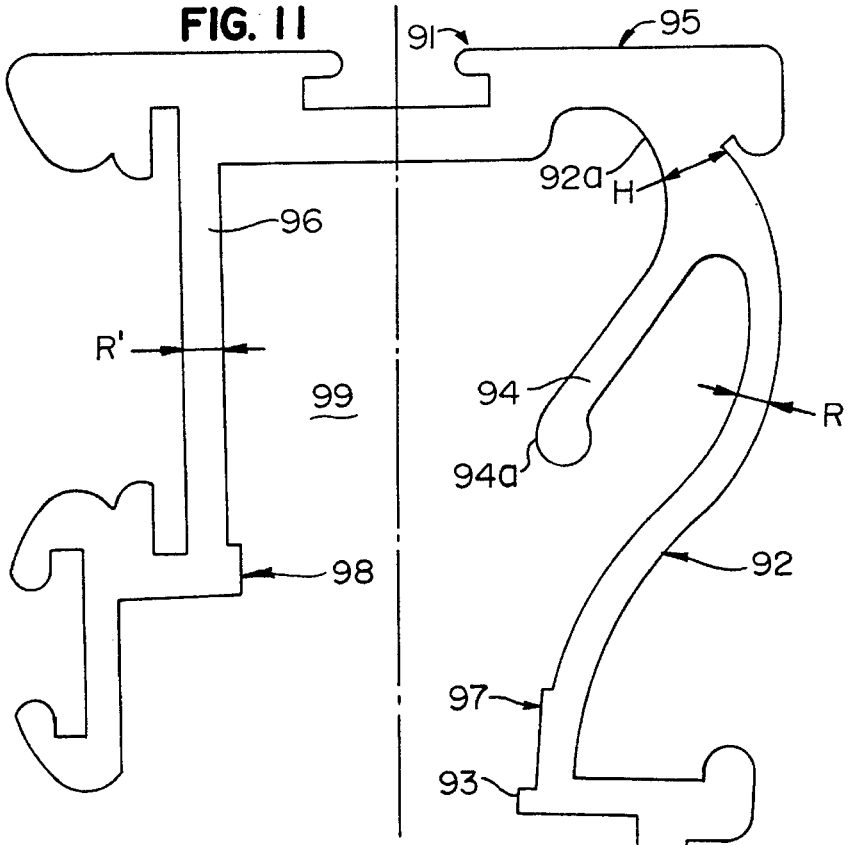
FIGS. 11 and 12 are section views showing other embodiments of the covering second section bar.

In the example of a covering second section bar 91 as shown in FIG. 11, there can similarly be found a first side branch 92 having a curved outer projection and terminated by a snap-fastening shoulder 93; there can also be found an intermediate branch 94 connected to the first side branch 92 towards the front portion thereof, close to the cross-bar 95. The thickness H of said first branch 92 in the portion 92*a* between the connection with the intermediate branch 94 and the cross-bar 95 is greater than the thickness h of said side branch 92 beyond the connection. The section bar 91 has a second side branch 96 which is also elastically deformable, having a thickness h' which is less than H, and in the example shown is greater than h.

The three bearing zones are respectively: first, the snap-fastening shoulder 93 or the portion 97 of the first side branch 92 situated in the immediate proximity of said shoulder 93; secondly, the free end 94*a* of the intermediate branch 94; and thirdly, a shoulder 98 facing towards the inner housing 99 of the section bar 91 and disposed at the end of the second side branch 96.

When either a panel to be covered or else a first section bar is inserted into the inner housing 99, it is possible to act on three levels of elastic deformation as a function of the forces involved. It will be understood that these forces depend on how far the various side and intermediate branches 92, 96, and 94 need to be displaced to enable insertion to take place and to enable the panel or the section bar to be installed against the three bearing zones. In order of decreasing amplitude, these three levels of elastic deformation are as follows: the first side branch 92; the second side branch 96; and the intermediate branch 94.

A given covering section 91 is theoretically designed for a given size of panel or size of first section bar. In practice, given the tolerances that are acceptable in the manufacture of section bars and of panels, errors can arise which, when they are cumulative, can give rise to significant differences. These differences can be compensated because of the overall elastic deformation of the section bar 91. The first level of deformation is designed to provide ordinary clamping without differences in dimension, or even with a difference that is negative; while the other levels of deformation are designed to enable alternate opening of the branches up to large differences, but without running the risk of breaking the section bar. In the present case, it is not a single zone of the section bar that deforms, but rather the entire section bar starting from the three zones particularly designed for deformation. The deformation zones preferably alternate from side to side of the housing so as to enable the panel to be centered more accurately on being inserted.

The advantages described above for the section bar 91 having three deformable branches are to be found to a lesser extent in the variants described above having two, or only one, elastically deformable branch and on which the invention is based.

Figure 12:
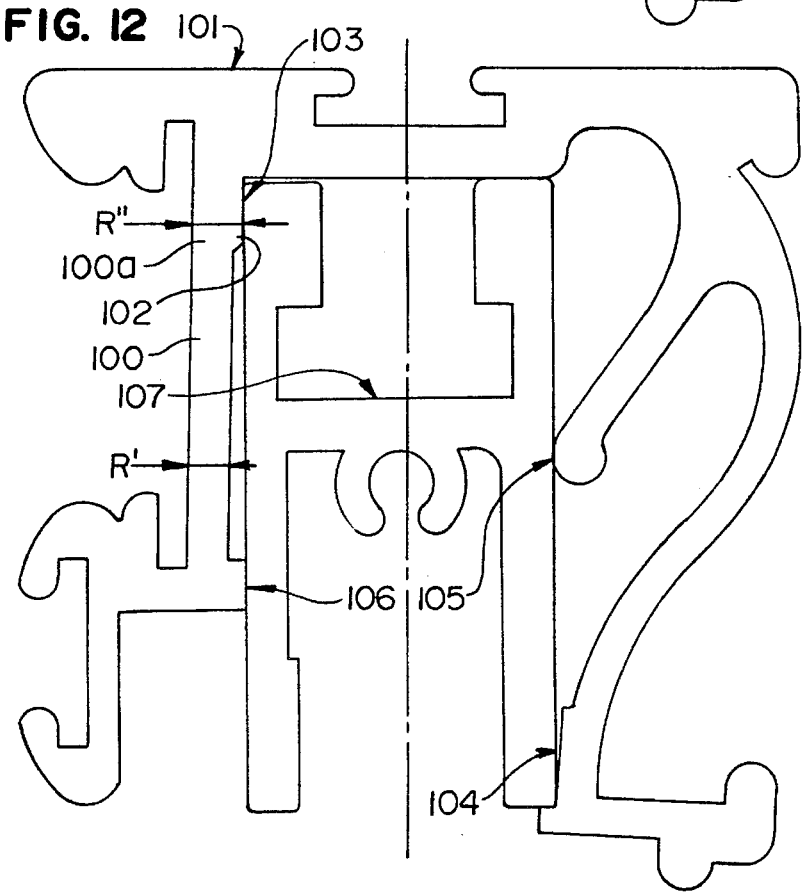

In the example shown in FIG. 11, the second side branch 96 is of uniform thickness h'. In the example shown in FIG. 12, the thickness of the second side branch 100 advantageously varies along its length, being greater h" in its front portion 100*a* close to the cross-bar 101. In a preferred embodiment, the extra thickness (h"−h') constitutes an inner shoulder 102 that acts as a fourth bearing zone 103. This embodiment is particularly advantageous for obtaining perfectly centered positioning of the panels or section bars 107 should they have large differences compared with the dimensions normally expected by the section bar.

In this case, there are still three alternate levels of deformation, but two wedging effects occur because stresses are applied firstly to the first triangle constituted by the first second and third bearing zones 104, 105, and 106, and secondly to the second triangle constituted by the third, fourth, and second bearing zones 106, 103, and 105.

As will be understood, the invention is not limited to the embodiments described above. In particular, although the H-shape of the first section bar 2 is particularly advantageous since it enables a single section bar to be used with panels of different thicknesses, the invention is not limited thereto. It would naturally be possible to use a section bar for a panel of greater thickness by forming a rabbet along the edge that is designed to be received inside the first section bar.

In the two examples shown in FIGS. 2 and 3, the two side branches of the second section bar 3 are not of the same length. Consequently, when the first section bar 2 is inserted and snap-fastened in the second section bar 3, the first section bar 2 is not totally covered by the second section bar 3 such that a portion 48 of the outside face 5*a* of the first section bar remains visible. Naturally, the invention is not limited to that disposition and it is possible to design other types of second section bar 3 that provide total covering of the first section bar 2.

In addition, the frame element 1 of the invention is designed to be positioned more particularly on the vertical edges of a panel. In particular when the panel constitutes a sliding door, its horizontal edges are also enclosed in section bars that constitute cross-members and that bear against the second section bar of the frame element 1 of the invention. When, as shown in the two examples of FIGS. 2 and 3, the second section bars have one side branch that is shorter than the other, then the section bars acting as cross-members must include cutouts for accommodating such an offset between their two bearing faces. In addition, the second section bar 3 may have special shape, such as those shown in FIG. 4 under references 49 and 50 that serve not only to accommodate the section bars of the cross-members, but also to hide the end joints where these cross-members come into contact with the second section bar 3. In FIG. 4, there can be seen a cross-member section bar 51 whose side outer edges are cut so as to fit along the special shapes 49 and 50. Such a section bar has thickness steps enabling it to be adapted from the outer faces of the panel 14 up to the special shapes 49 and 50 of the second section bar 3.

When a door 71 is to be made using a plurality of decorative panels, a first section bar of the invention may be used for assembling the individual panels together so as to build up a single panel. Naturally, under such circumstances, if the individual panels are all of the same thickness, it will be necessary to use first section bars having inner housings that are identical or else to form rabbets so as to compensate panel thicknesses so as to enable them to be inserted in the corresponding housings.

Under such circumstances, the first section bar that serves to assemble two unit panels together may act, for example, as an intermediate horizontal cross-member in which case it will need to be fixed at each end to respective vertical frame elements. Such fixing is advantageously performed by means of a screw passing through the cross-bar 6 of the first vertical section bar and received in the screw channel 52 mounted in the cross-bar of the first section bar that acts as the intermediate cross-member.

Figure 7:
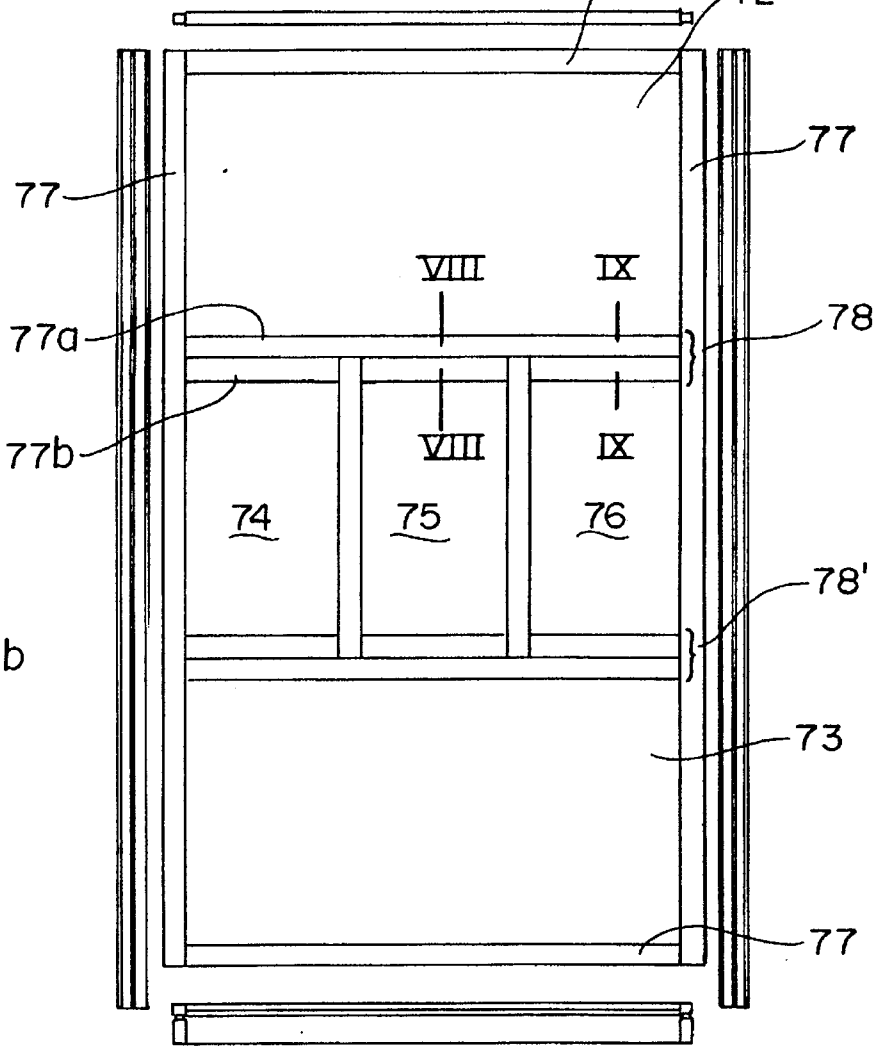
FIG. 7 is a face view of a partially assembled door prior to being framed by means of the element of the invention.

In the example of FIG. 7, a door 71 is made up of five decorative panels: two rectangular panels 72 and 73 of large size placed respectively at the top and at the bottom of the door 71, and three rectangular panels of small size 74, 75, 76 placed between the two above-mentioned panels 72 and 73. The middle small panel 75 is of thickness d that is smaller than the thickness D of the large top panel 72 whereas the small panels 74 and 76 on either side thereof have the same thickness D as the large panels 72 and 73.

Figure 9:
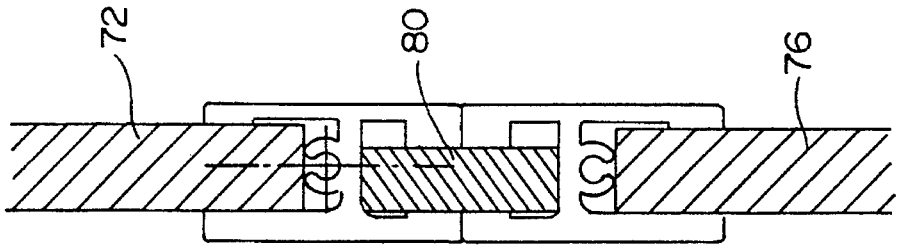
FIGS. 8 and 9 are section views of FIG. 7 on lines VIII—VIII and IX—IX.
Figure 8:
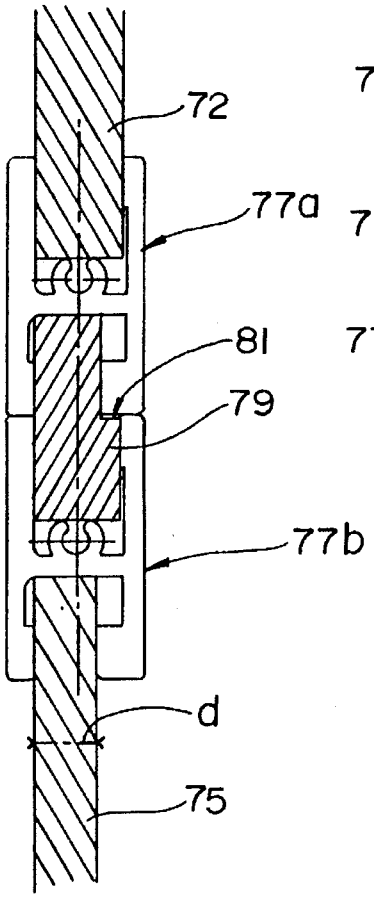

The same first section bar 77 is used for framing all of the panels, with the two first section bars 77*a* and 77*b* being assembled together so as to constitute the intermediate horizontal cross-members 78 and 78'. Such assembly is achieved by means of blocks 79 and 80 (FIGS. 8 and 9). FIG. 8 is a section through the assembly of two first section bars 77*a* and 77*b* that are connected to panels 72 and 75 of different thicknesses. The inner block 79 which occupies the two adjacent inner housings of the two first section bars 77*a* and 77*b* has a rabbet 81 for compensating the differences of thickness of said two housings.

In FIG. 9, the two panels 72 and 76 have the same thickness.

Under such circumstances, the block 80 is of uniform thickness.

Because of the frame element of the invention, and its two section bars, it is possible to implement all kinds of door framing, in particular cupboard doors that slide or that pivot or indeed other types of decorative elements that are suitable for being framed.

Figure 10:
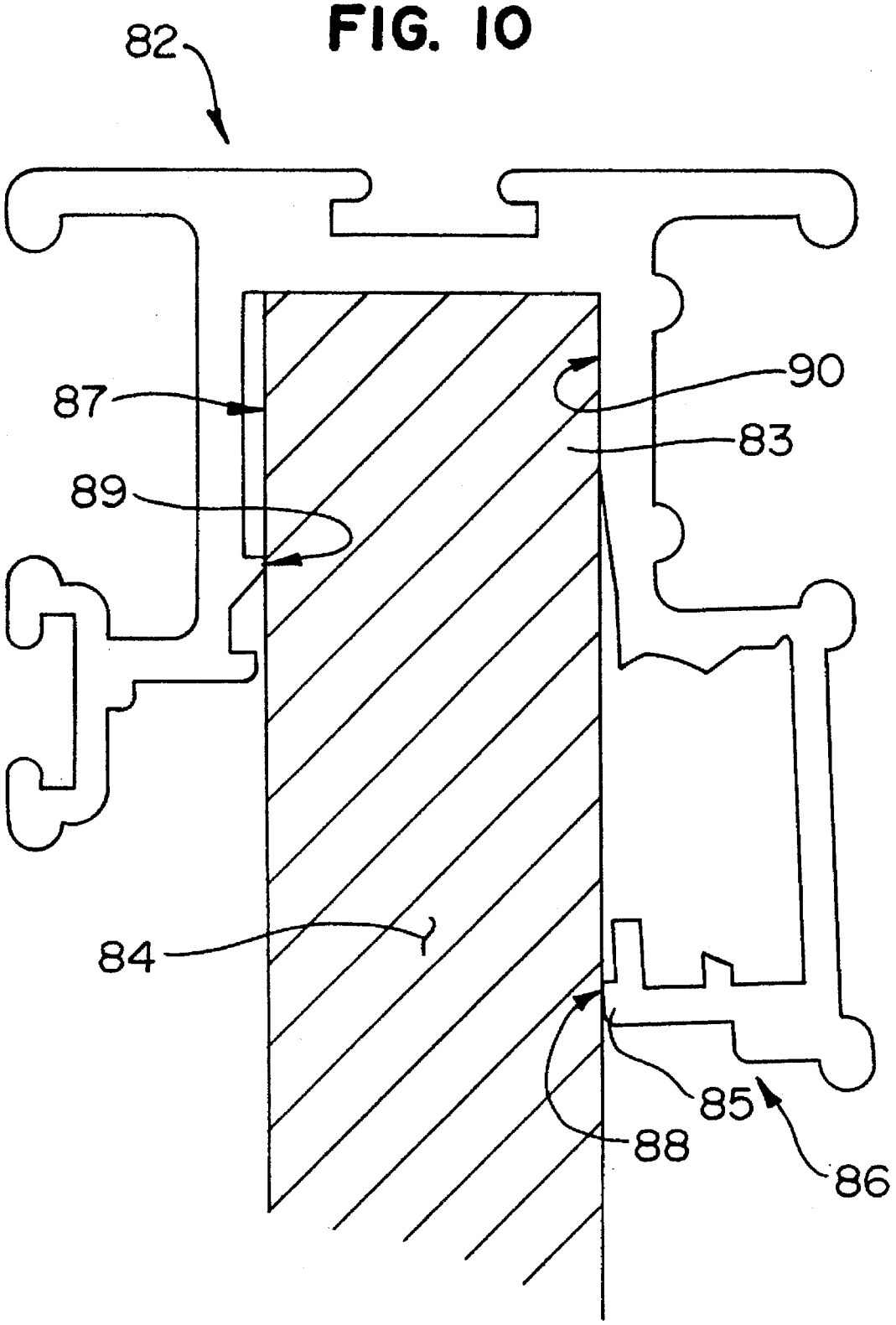
FIG. 10 is a section view through the second section bar of FIG. 2 covering the edge of a panel.

It should be observed that each of the two preferred section bars of the invention may advantageously be implemented independently as a section bar for fixing together two panels in the case of the first section and as illustrated above in FIGS. 8 and 9, and as a panel-covering section bar for the second section bar, as shown in FIG. 10.

Naturally, for the second section bar 82 that directly covers the edge 83 of a panel 84, the shoulder 85 is no longer, properly speaking, a snap-fastening shoulder, but it constitutes a fastening shoulder that is forced against the panel after elastic deformation of the branch 86 has enabled the edge 83 to be inserted into the inner housing 87 of the section bar 82. The pressure exerted on the panel 84 by means of this fastening shoulder 85 prevents the panel 84 from being removed from the housing 87 without additional deformation of the branch 86. Under such circumstances, the face 88 of the shoulder 85 acts as the first bearing zone, the edge 83 of the panel 84 also bearing against the second and third bearing zones 89 and 90 corresponding to the zones referenced 24*a* and 20*a* in FIG. 3.

I claim:

1. A section bar for covering the edge of a panel including a generally U-shaped inner housing defined by two side branches and by a cross-bar, wherein the first side branch has a fastening shoulder and is elastically deformable at a first level of deformation, the first side branch being of smaller thickness than the mean thickness of the section bar, at least in a zone where elastic deformation is required, and wherein the inner housing includes a first bearing zone corresponding to the fastening shoulder, a second bearing zone situated on the same side of the inner housing, and a third bearing zone situated on the second side branch and located at an intermediate distance between the first and second bearing zones.

2. A section bar according to claim 1, wherein its cross-section is generally U-shaped, in which the elastically deformable first side branch is of a first given thickness and includes a front portion that acts as the second bearing zone close to the cross-bar, and a rear portion which includes said fastening shoulder and which is of a second thickness that is less than the given first thickness.

3. A section bar according to claim 1, wherein the end of the elastically deformable first side branch has an L-shaped cross-section including one flange that acts as said fastening shoulder.

4. A section bar according to claim 1, wherein the elastically deformable first side branch includes an outwardly directed projection.

5. A section bar according to claim 4, wherein the cross-section of the projection is U-shaped.

6. A section bar according to claim 5, wherein, when said section bar is used for a pivoting door, a pivot shaft of said door is mounted inside the U-shaped projection of the elastically deformable first side branch.

7. A section bar according to claim 4, wherein the cross-section of the outwardly directed projection is curved in shape, including an intermediate branch situated in the inside zone of the projection and supporting the second bearing zone.

8. A section bar according to claim 7, wherein the intermediate branch is connected to the cross-bar, perpendicularly thereto.

9. A section bar according to claim 7, wherein the intermediate branch is itself elastically deformable at a third level of deformation and is obliquely connected to the elastically deformable first side branch in a front portion of the first side branch close to the cross-bar, said first side branch having a first given thickness between the connection and the cross-bar, and a second thickness that is less than the first given thickness between the connection and its own free end, the free end of the intermediate branch constituting the second bearing zone.

10. A section bar according to claim 1, wherein the second side branch is also elastically deformable at a second level of deformation, having a thickness that is less than the thickness of the first side branch outside its zone of elastic deformation.

11. A section bar according to claim 1, wherein one of the first and second side branches includes an outside face suitable for receiving a sealing element, and the other side branch includes a shoulder suitable for co-operating with such a sealing element.

12. A section bar according to claim 1, wherein one of the first and second side branches includes a grooved shoulder suitable for slidably receiving a sealing element, and the other side branch includes an outer bearing face suitable for co-operating with such a sealing element.

13. A section bar according to claim 1, wherein one of the first and second branches includes a grooved shoulder suitable for slidably receiving a decorative strip.

14. A panel frame element comprising a panel-fixing first section bar including an inner housing for receiving an edge of a panel, and having an elastically deformable branch for bearing against the edge of the panel after the edge has been forced into the inner housing of said first section, and a second covering section bar including a generally U-shaped inner housing defined by two side branches and by a cross-bar, wherein the first side branch has a snap-fastening shoulder for snap-fastening engagement on the first section bar and is elastically deformable at a first level of deformation, the first side branch being of smaller thickness than the mean thickness of the second section bar, at least in a zone where elastic deformation is required, the elastically deformable first side branch of the second section bar bearing against the first section bar clamping the edge of the panel after the first section bar has been forced into the inner housing of said second section bar, and wherein the inner housing of the second section bar includes a first bearing zone situated close to the snap-fastening shoulder, a second bearing zone situated on the same side of the inner housing of the second section bar, and a third bearing zone situated on the second side branch and located at an intermediate distance between the first and second bearing zones.

15. The panel frame element according to claim 14, wherein the elastically deformable branch of the first section bar is of a thickness that is less than the mean thickness of the first section bar, at least in a zone where elastic deformation is required.

16. An element according to claim 14, wherein the fixing first section bar has a substantially H-shaped cross-section that defines two inner housings of substantially U-shaped cross-section, each having one branch of its U-shape that is elastically deformable, thereby enabling the first section bar to be used with panels of two different thicknesses.

17. A door constituted by a plurality of assembled panels and framed along its vertical edges by means of frame elements according to claim 14, wherein said panels are assembled to one another by a plurality of first section bars of an H-shaped cross-section that defines two inner housings of substantially U-shaped cross-section, each having one branch of its U-shape that is elastically deformable, thereby enabling the first section bar to be used with panels of two different thicknesses.

18. A section bar for covering the edge of a first section bar, including a generally U-shaped inner housing defined by two side branches and by a cross-bar, wherein the first side branch has a snap-fastening shoulder and is elastically deformable at a first level of deformation, the first side branch being of smaller thickness than the mean thickness of the section bar, at least in a zone where elastic deformation is required, and wherein the inner housing includes a first bearing zone situated close to the snap-fastening shoulder, a second bearing zone situated on the same side of the inner housing, and a third bearing zone situated on the second side branch and located at an intermediate distance between the first and the second bearing zones.

19. A section bar according to claim 18, wherein its cross-section is generally U-shaped, in which the elastically deformable first side branch is of a first given thickness and includes a front portion that acts as the second bearing zone close to the cross-bar, and a rear portion which includes said snap-fastening shoulder and which is of a second thickness that is less than the given first thickness.

20. A section bar according to claim 18, wherein the end of the elastically deformable first side branch has an L-shaped cross-section including one flange that acts as said snap-fastening shoulder, and another flange that acts as the first bearing zone.

21. A section bar according to claim 18, wherein the elastically deformable first side branch includes an outwardly directed projection.

22. A section bar according to claim 21, wherein the cross-section of the projection is U-shaped.

23. A section bar according to claim 22, wherein, when said section bar is used for a pivoting door, a pivot shaft of said door is mounted inside the U-shaped projection of the elastically deformable first side branch.

24. A section bar according to claim 21, wherein the cross-section of the outwardly directed projection is curved in shape, including an intermediate branch situated in the inside zone of the projection and supporting the second bearing zone.

25. A section bar according to claim 24, wherein the intermediate branch is connected to the cross-bar, perpendicularly thereto.

26. A section bar according to claim 24, wherein the intermediate branch is itself elastically deformable at a third level of deformation and is obliquely connected to the elastically deformable first side branch in a front portion of the first side branch close to the cross-bar, said first side branch having a first given thickness between the connection and the cross-bar, and a second thickness that is less than the first given thickness between the connection and its own free end, the free end of the intermediate branch constituting the second bearing zone.

27. A section bar according to claim 18, wherein the second side branch is also elastically deformable at a second level of deformation, having a thickness that is less than the thickness of the first side branch outside its zone of elastic deformation.

28. A section bar according to claim 18, wherein one of the first and second side branches includes an outside face suitable for receiving a sealing element, and the other side branch includes a shoulder suitable for cooperating with such a sealing element.

29. A section bar according to claim 18 wherein one of the first and second branches includes a grooved shoulder suitable for slidably receiving a sealing element, and the other side branch includes an outer bearing face suitable for co-operating with such a sealing element.

* * * * *